United States Patent [19]

McCant

[11] Patent Number: 4,913,388

[45] Date of Patent: Apr. 3, 1990

[54] MOVABLE BASKETBALL BACKBOARD

[76] Inventor: Robert McCant, 1119 Montrose, Toledo, Ohio 43607

[21] Appl. No.: 250,359

[22] Filed: Sep. 28, 1988

[51] Int. Cl.[4] ..... A47G 29/00

[52] U.S. Cl. ..... 248/125; 248/158; 248/910

[58] Field of Search ..... 248/125, 121, 122, 123.1, 248/124, 164, 431, 432, 163.1, 159, 158, 364, 910; 273/1.5 R

[56] References Cited

U.S. PATENT DOCUMENTS

| | | | |
|---|---|---|---|
| 1,924,811 | 8/1933 | Schulz | 273/1.5 R |
| 2,144,148 | 1/1939 | Gross | 273/1.5 R |
| 2,227,310 | 12/1940 | Hoppes | 273/1.5 R |
| 2,313,188 | 3/1943 | Woodburn | 273/1.5 R |
| 3,341,197 | 9/1967 | Bottorff | 273/1.5 R |
| 3,716,234 | 2/1973 | Lancellotti | 248/158 |
| 4,793,611 | 12/1988 | Thornell | 248/DIG. 10 |

*Primary Examiner*—J. Franklin Foss
*Attorney, Agent, or Firm*—George R. Royer

[57] ABSTRACT

The subject apparatus is a movable basketball backboard framework, which is readily movable from one position to another. Such framework comprises, in general, a base frame having a triangular disposition, with a vertically disposed spinal support member, integrally disposed on the upper portions of the vertical spinal support member is a flat basketball backboard member.

3 Claims, 1 Drawing Sheet

MOVABLE BASKETBALL BACKBOARD

DISCUSSION OF PRIOR ART OF THE SUBJECT INVENTION

This invention relates to athletic and sporting equipment in general, and most particularly relates to a supporting framework for a basketball backboard. However, the scope of the subject invention goes beyond a framework for deploying a basketball backboard, and may be used to support and deploy other athletic devices that are generally supported above the ground.

The subject invention is most substantially and directly made applicable to a supporting framework arrangement for holding in an upright position above the ground, a basketball backboard in its usually playing position. In this respect, there are several devices known in the prior art that are used to support basketball backboards. There are an array of free-standing vertically disposed support members structured and used for this purpose. These prior art structures possess certain drawbacks, one of which is the difficulty of transporting back and forth. Another problem with these prior art structures is the fact that they generally are not vertically stable. Yet another problem is the fact that existing art structures are complex in structure and thus expensive to manufacture. It is these latter problems to which the subject invention is addressed and the following objects of the subject invention are directed accordingly.

OBJECTS

The following are objects of the subject invention:

It is an object of the subject invention to provide an improved device for supporting a basketball backboard or similar athletic device;

Yet another object of the subject invention is to provide an improved athletic framework;

Still another object of the subject invention is to provide an improved device for a movable supporting framework for a basketball backboard.

Other and further objects of the subject invention will become apparent from a reading of the following description taken in conjunction with the claims.

DRAWINGS

DESCRIPTION OF GENERAL EMBODIMENT

The subject apparatus is a movable basketball backboard framework, which is readily movable from one position to another. Such framework comprises, in general, a base frame having a triangular disposition, with a vertically disposed spinal support member. Integrally disposed on the upper portions of the vertical spinal support member is a flat basketball backboard member.

DESCRIPTION OF PREFERRED EMBODIMENT

Figure 1:
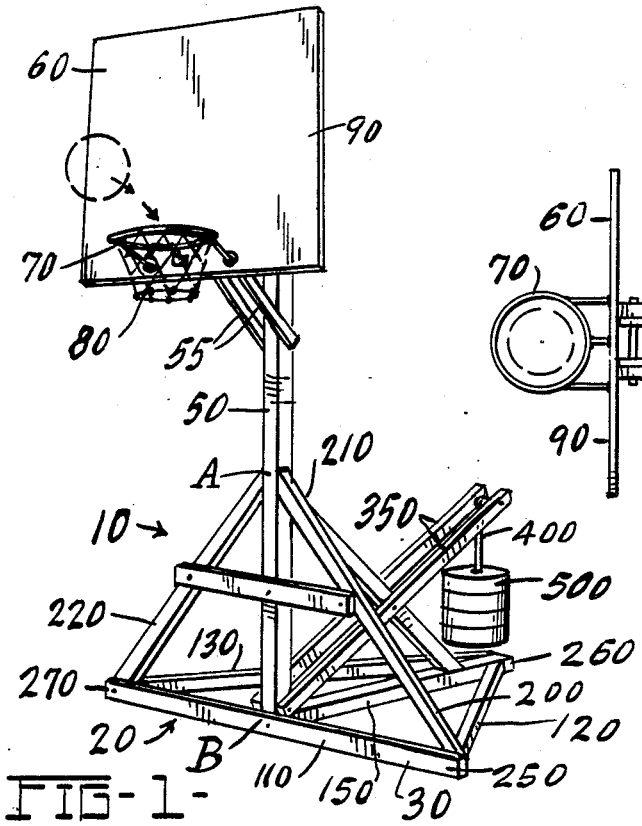
FIG. 1 is a perspective view of the subject invention.

Referring now to the drawings in which a preferred embodiment of the subject invention is shown, a basketball backboard support apparatus 10 is shown in the drawings, and as particularly seen in FIG. 1, the apparatus comprises a base member 20 adapted to rest flush against the ground 30, a vertically disposed spinal support member 50 integrally connected to such base support member in a perpendicular manner so as to be vertically erect. Integrally disposed through a diagonally disposed support member 55 to the upper portion of said vertical support member 50 is a rectangularly shaped basketball backboard 60 of generally conventional construction. A basketball rim 70, with net 80 is affixed to the frontal face 90 of such basketball backboard. The affixation of the basketball backboard 60 to the upper portion of the spinal support member 50 is conventional in structure.

Figure 2:
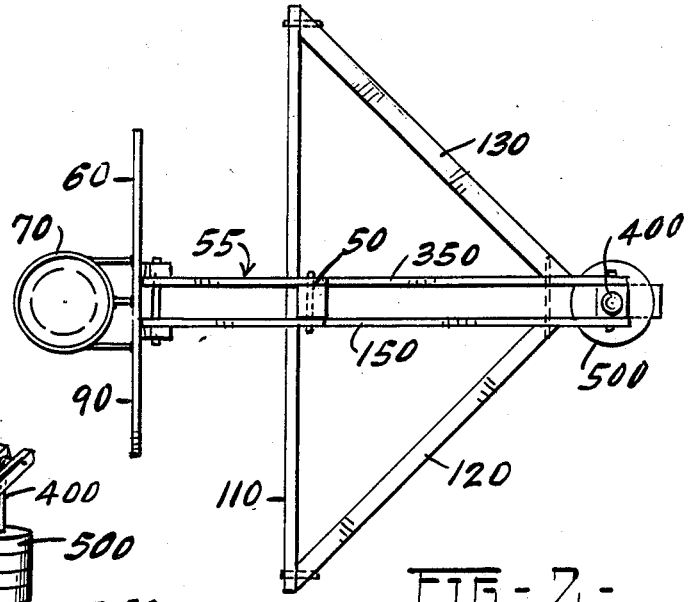
FIG. 2 is a top elevational view of the subject invention.
Figure 3:
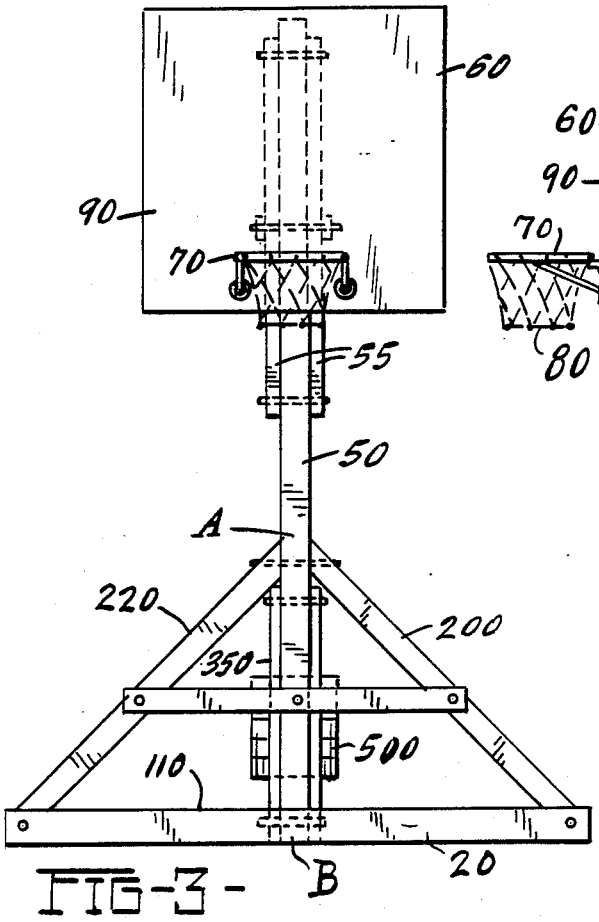
FIG. 3 is a front elevational view of the subject invention.
Figure 4:
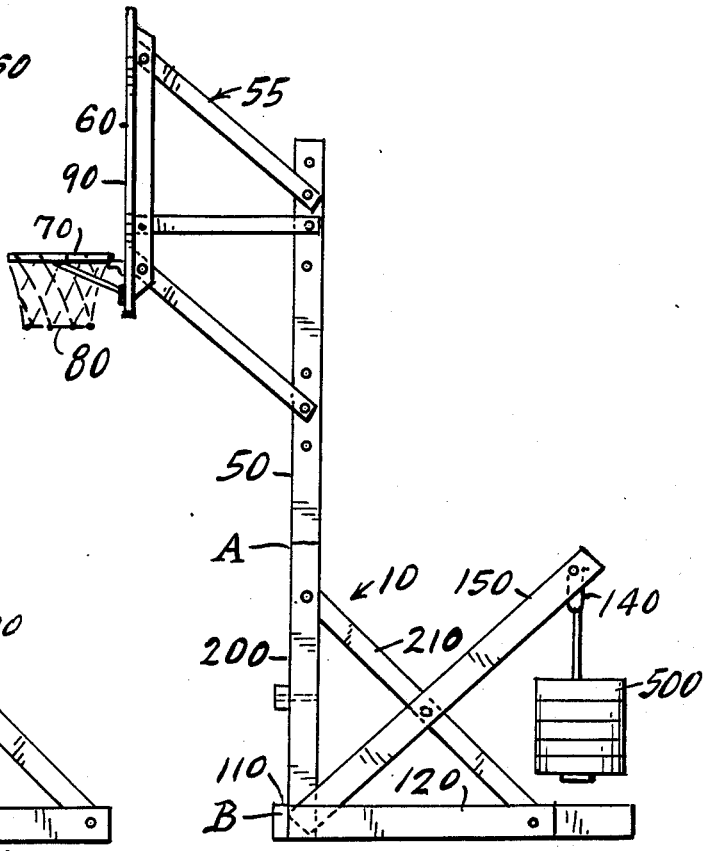
FIG. 4 is a side elevational view of the subject invention.

More specifically, as shown in FIGS. 1, 2 and 3, the base member 20 is consttucted as a triangular member with the frong leg 110 being preferably parallel to the front face of the backboard member, as shown in the drawings. The remaining legs 120 and 130 of such base member 20 are formed as the opposing legs of an isosceles triangle, as particularly shown in FIG. 2, As shown in the drawings, the base member also has a leg 150 extending in a perpendicular manner from the front leg of the triangle to the apex of the triangle, as shown.

Moreover, as seen in the drawings, interconnected between the base member 20 and the spinal support member 50 are diagonal support struts 200, 210 and 220, which function as support devices between the spinal support member 50 and the base member 20. In particular, diagonal support member 200 extends from corner 250 of base member 20 to point A along the spinal support member 50. Diagonal support member 210 extends from corner 260 of base member 20 to point A on the spinal support member 50, while diagonal support member 200 extends from corner 270 of base member 20 to the same point A on the spinal support member.

As seen in the drawings, a counterweight device is shown, which counterweight device is a diagonally disposed brace member 350 integrally affixed at point B, which is where the bottom of the spinal support member 50 is joined to base member 20 at front leg 110. The diagonal brace 350 is affixed in a position that extends at an angle of approximately thirty to forty-five degrees from point B of the base relative to the ground. Moreover, as shown, the diagonal brace 400 is bifurcated, that is, formed of two parallel members separated a given distance. Diagonal support member 230 extends in an intersecting manner through such space, as shown.

At the distal end of diagonal brace 350 is a holder 400, in the form of a vertical member upon which weights 500 can be placed to function as a counterbalance. At any time the weights can be removed to permit the apparatus to be moved about over the ground.

I claim:

1. A movable upright support for a basketball backboard, comprising in combination:

(a) a base member having a frontal portion and a posterior portion adapted to rest flush against the ground, said base member comprisng a triangular structure adapted to rest flush against the floor, and said base member having a frontal portion and a posterior portion;

(b) a vertically upright spinal support member having a lower end and an upper end, integrally connected to said base member, with diagonal supports connecting a portion of said spinal support member with the frontal portion of said base member;

(c) a basketball backboard integrally affixed to the upper portion of said vertically upright spinal support member;

(d) balancing means affixed to the base member, said balancing means comprising a diagonally disposed member having a frontal portion and a posterior portion with said frontal portion of said diagonally disposed member being affixed to the lower end of said spinal support member, with the diagonally disposed member extending upwardly extending towards the posterior portion of said base member, with weight means affixed on the posterior portion of said base member.

2. A movable basketball backboard support comprising:

(a) a base support member;

(b) a vertical spinal support member;

(c) means on said vertical support member to hold a basketball backboard;

(d) balancing means affixed to the base member, said balancing means comprising a diagonally disposed member having a frontal portion and a posterior portion with said frontal portion of said diagonally disposed member being affixed to the lower end of said spinal support member, with the diagonally disposed member extending upwardly extending towards posterior portion of said base member, with weight means affixed on the posterior portion of said base member.

3. A basketball backboard which is movable from one location to another, said basketball backboard comprising:

(a) a base member, said base member being comprised in part of a triangular frame, which triangular frame is adapted to rest flush against the ground, said base member having a frontal portion and a posterior portion;

(b) vertically disposed and longitudinally extending spinal support means having an upper end and a lower end, with the lower end of such spinal support means being integrally affixed to a portion of said base member, said latter affixed relationship forming a juncture between said base member and said spinal support;

(c) balancing means in the form of a diagonal beam having a lower end and upper end with the lower end being integrally affixed at the juncture between said base member and said spinal support member, said balancing means comprising a diagonally disposed member having a frontal portion and a posterior portion with said frontal portion of said diagonally disposed member being affixed to the lower end of said spinal support member, with the diagonally disposed member extending upwardly extending towards the posterior portion of said base member, with weight means affixed on the posterior portion of said member;

(d) basketball backboard means affixed to the upper portion of said spinal support.

* * * * *